US012564209B2

(12) United States Patent
Capo et al.

(10) Patent No.: US 12,564,209 B2
(45) Date of Patent: Mar. 3, 2026

(54) CASTING APPARATUS AND METHOD FOR THE PRODUCTION OF A CAST SHEET OF A MATERIAL CONTAINING ALKALOIDS

(71) Applicant: PHILIP MORRIS PRODUCTS S.A., Neuchatel (CH)

(72) Inventors: Silvia Capo, Capaccio-Paestum (IT); Chiara Fasciani, Avekzzano (IT); Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 1184 days.

(21) Appl. No.: 16/972,673

(22) PCT Filed: Jun. 28, 2019

(86) PCT No.: PCT/EP2019/067478
§ 371 (c)(1),
(2) Date: Dec. 7, 2020

(87) PCT Pub. No.: WO2020/002682
PCT Pub. Date: Jan. 2, 2020

(65) Prior Publication Data

US 2021/0212355 A1 Jul. 15, 2021

(30) Foreign Application Priority Data

Jun. 29, 2018 (EP) ..... 18181000

(51) Int. Cl.
*A24B 3/14* (2006.01)
*A24B 15/14* (2006.01)
*A24C 5/01* (2020.01)

(52) U.S. Cl.
CPC ..... *A24B 3/14* (2013.01); *A24B 15/14* (2013.01); *A24C 5/01* (2020.01)

(58) Field of Classification Search
CPC ..... A24B 3/14; A24B 15/14; A24C 5/01
See application file for complete search history.

(56) References Cited

U.S. PATENT DOCUMENTS 3,098,492 A 7/1963 Wuzburg
4,325,391 A 4/1982 Schmidt
(Continued)

FOREIGN PATENT DOCUMENTS

EP 0565360 10/1993
JP S39-8155 5/1939
(Continued)

OTHER PUBLICATIONS

Search Report and Written Opinion for PCT/EP2019/067478 dated Sep. 19, 2019 (11 pages).
(Continued)

*Primary Examiner* — Michael H. Wilson
*Assistant Examiner* — Jennifer A Kessie
(74) *Attorney, Agent, or Firm* — Mueting Raasch Group

(57) ABSTRACT

The present invention relates to a casting apparatus (100) for the production of a cast sheet of a material containing alkaloids, the casting apparatus comprising: •a casting box (10) adapted to contain a slurry (18) of the material containing alkaloids; •a slurry supply element (5) adapted to feed the slurry to the casting box; •a movable support (2); •a casting blade (1) adapted to cast the slurry contained in the casting box onto the movable support so as to form the cast sheet; and •path diverting fins (12, 13) adapted to come into contact with the slurry and placed within the casting box. The invention also relate to a method to cast a sheet.

17 Claims, 6 Drawing Sheets

(56) References Cited

U.S. PATENT DOCUMENTS

| | | | | |
|---|---|---|---|---|
| 10,060,270 | B2 | 8/2018 | Lee | |
| 10,463,068 | B2 | 11/2019 | Soo | |
| 2017/0340002 | A1* | 11/2017 | Soo | A24B 3/14 |

FOREIGN PATENT DOCUMENTS

| | | | |
|---|---|---|---|
| JP | S50-58306 | 5/1975 | |
| JP | 2018-500017 | 1/2018 | |
| JP | 2018-512536 | 5/2018 | |
| WO | WO 2016/050471 | 4/2016 | |
| WO | WO-2016096963 A1 * | 6/2016 | A24B 15/12 |

OTHER PUBLICATIONS

Office Action issued in Japan for Application No. 2020-568687 dated May 29, 2023 (10 pages). English translation included.

* cited by examiner

CASTING APPARATUS AND METHOD FOR THE PRODUCTION OF A CAST SHEET OF A MATERIAL CONTAINING ALKALOIDS

This application is a U.S. National Stage Application of International Application No. PCT/EP2019/067478 filed Jun. 28, 2019, which was published in English on Jan. 2, 2020 as International Publication No. WO 2020/002682 A1. International Application No. PCT/EP2019/067478 claims priority to European Application No. 18181000.3 filed Jun. 29, 2018.

This invention relates to a casting apparatus and method for producing a cast web of a material containing alkaloids.

In particular, the material containing alkaloids is a homogenized tobacco material, preferably used in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf (TCL is the acronym for tobacco cast leaf). The process to form homogenized tobacco material sheets commonly comprises a step in which tobacco dust and a binder, are mixed to form a tobacco slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. A process for making such homogenized tobacco is for example disclosed in European Patent EP 0565360.

In a "heat-not-burn" aerosol-generating article, an aerosol-forming substrate is heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a "heat-not burn" aerosol-generating article. This means that the aerosol composition that is generated by such a "heat-not burn" aerosol-generating article is substantially only based on the homogenized tobacco material. Therefore, it is important to have good control over the composition of the homogenized tobacco material, for the control for example, of the taste of the aerosol.

Due to variations in the physical properties of the slurry, for example, consistency, viscosity, fibre size, particle size, moisture or the age of the slurry, standard casting methods and apparatus may result in unintended variations in the application of the slurry onto a support during the casting of web of homogenized tobacco. A non-optimal casting method and apparatus may lead to inhomogeneity and defects in the cast web of homogenized tobacco.

Inhomogeneity in the homogenized tobacco web may lead to difficulties in subsequent handling of the homogenized tobacco web for the production of the aerosol-generating article. For example, inhomogeneity may lead to tearing or even rupture of the web during manufacturing or further processing of the web. This in turn could, for example, result in machine stops. Additionally, an inhomogeneous tobacco web may create unintended difference in the aerosol delivery between aerosol generating articles that are produced from the same homogenized tobacco web.

There is a need for a casting apparatus and method for the production of a cast web of a material containing alkaloids that is adapted to overcome, or at least decrease, the above-mentioned issue.

The invention relates to a casting apparatus for the production of a cast sheet of a material containing alkaloids, the casting apparatus comprising: a casting box adapted to contain a slurry of the material containing alkaloids; a slurry supply element adapted to feed the slurry to the casting box; a movable support; a casting blade adapted to cast the slurry contained in the casting box onto the movable support so as to form the cast sheet; and path diverting fins adapted to come into contact with the slurry and placed within the casting box.

The proposed casting apparatus aims to achieve a uniform slurry deposition on the movable support. The presence of the fins in the flow path of the slurry increases the mixing of the slurry before casting, so that improvements on the control of cast sheet thickness may be expected. In the flow towards the casting blade, the slurry has to contour the fins, dispersing and creating non-linear paths. A linear flow of the slurry is thus substantially avoided.

As used herein, the terms "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters. A continuous "sheet" is herein called "web".

As used herein, the term "casting blade" denotes a longitudinally shaped element that may have an essentially constant cross-section along major parts of its lengthwise extension. It shows at least one edge that is intended to come into contact with a pasty, viscous or liquid-like substance to be influenced by said edge, such as a slurry. Said edge may have a sharp and knife-like shape. Alternatively, the blade may have a rectangular or a rounded shape.

As used herein, the term "movable support" denotes any means comprising a surface that can be moved in at least one direction. The movable support may form a closed loop so to provide an uninterrupted transporting ability in one direction. However, the movable support may be moved in a back and forth moving way as well. The movable support may include a conveyor belt. The movable support may be essentially flat and may show a structured or an unstructured surface. The movable support may show no openings in its surface or may show only orifices of such a size that they are impenetrable for the slurry deposited on it. The movable support may comprise a sheet-like movable and bendable band. The band may be made of a metallic material, including but not limited to steel, copper, iron alloys and copper alloys, or of a rubber material. The band may be made of a temperature-resistant material so that it can be heated to speed up the drying process of the slurry.

As used herein, the term "slurry" denotes a liquid-like, viscous or pasty material that may comprise an emulsion of different liquid-like, viscous or pasty material and that may contain a certain amount of solid-state particles, provided that the slurry still shows a liquid-like, viscous or pasty behaviour.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

As used herein, the term "homogenised tobacco material" denotes material formed by agglomerating particulate tobacco, which contains the alkaloid nicotine. The material containing alkaloids can thus be a homogenized tobacco material.

The most commonly used forms of homogenized tobacco material are reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition may be then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The homogenized tobacco sheet generally includes, in addition to the tobacco, a binder and an aerosol-former, such as guar and glycerin.

As used herein, the term "aerosol forming material" denotes a material that is capable of releasing volatile compounds upon heating to generate an aerosol. Tobacco, together with other compounds, may be classified as an aerosol forming material, particularly a sheet of homogenized tobacco comprising an aerosol former. An aerosol forming substrate may comprise or consist of an aerosol forming material. The homogenized tobacco sheet can be used as an aerosol forming material.

The slurry may comprise a number of different components or ingredients. These components may influence the properties of the cast web of material containing alkaloids. A first ingredient is a material containing alkaloids, for example in powder form. This material can be for example a tobacco powder blend, which preferably contains the majority of the tobacco present in the slurry. The tobacco powder blend is preferably the source of the majority of tobacco in the homogenized tobacco material and thus gives the flavor to the final product, for example to an aerosol produced by heating the homogenized tobacco material. A cellulose pulp containing cellulose fibers is preferably added to the slurry in order to increase the tensile strength of the alkaloids material web, acting as a strengthening agent. A binder may be preferably added. An aerosol-former may be preferably added. Binder and aerosol-former are preferably added in order to enhance the tensile properties of the homogenized sheet and promote the formation of aerosol. Further, in order to reach a certain viscosity and moisture optimal for casting the web of material containing alkaloids, water may be added to the slurry.

The quantity of binder added to the slurry may be comprised between about 1 percent and about 5 percent in dry weight of the slurry. More preferably, it is comprised between about 2 percent and about 4 percent. The binder used in the slurry may be any of the gums or pectins described herein. The binder may ensure that the tobacco powder remains substantially dispersed throughout the homogenized tobacco web. Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

The introduction of cellulose fibres in the slurry typically increases the tensile strength of the tobacco material web, acting as a strengthening agent. Therefore, adding cellulose fibres may increase the resilience of the homogenized tobacco material web. Cellulose fibres for including in a slurry for homogenized tobacco material are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof. Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo. The length of cellulose fibres is advantageously between about 0.2 millimetres and about 4 millimetres. Preferably, the mean length per weight of the cellulose fibres is between about 1 millimetre and about 3 millimetres. Further, preferably, the amount of the cellulose fibres is comprised between about 1 percent and about 7 percent in dry weight basis of the total weight of the slurry (or homogenized tobacco sheet).

Suitable aerosol-formers for inclusion in slurry for homogenised tobacco material are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol-formers are glycerine and propylene glycol.

The slurry may have an aerosol-former content of greater than about 5 percent on a dry weight basis. The slurry may have an aerosol former content of between about 5 percent and about 30 percent by weight on a dry weight basis. More preferably, the aerosol-former is comprised between about 10 percent to about 25 percent of dry weight of the slurry. More preferably, the aerosol-former is comprised between about 15 percent to about 25 percent of dry weight of the slurry.

The binder and the cellulose fibers are preferably included in a weight ratio comprised between about 1:7 and about 5:1. More preferably, the binder and the cellulose fibers are included in a weight ratio comprised between about 1:1 and about 3:1.

The binder and the aerosol-former are preferably included in a weight ratio comprised between about 1:30 and about 1:1. More preferably, the binder and the aerosol-former are included in a weight ratio comprised between about 1:20 and about 1:4.

Preferably, the alkaloid containing material is tobacco. The binder and the tobacco particles are preferably included in a weight ratio comprised between about 1:100 and about 1:10. More preferably, the binder and the tobacco particles are included in a weight ratio comprised between about 1:50 and about 1:15, even more preferably between about 1:30 and 1:20.

The aerosol-former and the tobacco particles are preferably included in a weight ratio comprised between about 1:20 and about 1:1. More preferably, the aerosol-former and the tobacco particles are included in a weight ratio comprised between about 1:6 and about 1:2.

The aerosol former and the cellulose fibres are preferably included in a weight ratio comprised between about 1:1 and about 30:1. More preferably, the aerosol-former and the cellulose fibres are included in a weight ratio comprised between about 5:1 and about 15:1.

The cellulose fibres and the tobacco particles are preferably included in a weight ratio comprised between about 1:100 and about 1:10. More preferably, the cellulose fibres and the tobacco particles are preferably included in a weight ratio comprised between about 1:50 and about 1:20.

The apparatus of the invention includes a casting box to contain the slurry and a movable support where the slurry is cast using a casting blade. The movable support in its movement defines a casting direction.

The slurry may reach the casting box from a different location. The casting box therefore might not be the place where the slurry is formed. For example, the slurry may be created in a silo, from where it is transferred to the casting box via suitable piping. Preferably, the slurry is continuously supplied to the casting box while the slurry is cast onto the movable support to form a continuous web of material containing alkaloids. The silo and the casting box are thus preferably fluidly connected in order to allow the slurry flow from one to the other.

The casting-box is preferably box-shaped. Preferably, the casting box includes walls. More preferably, the walls in turn comprise sidewalls. The sidewalls may include a first and a second couple of opposite walls, called first, second sidewalls in the first couple, and third and fourth sidewalls in the second couple. The sidewalls are preferably advantageously substantially vertical, or tilted with respect to a vertical plane. First and second sidewall, and third and fourth sidewall, are respectively one facing the other. Preferably, the walls of casting box also include a bottom wall. The bottom wall may include an aperture. Preferably, the whole bottom part of the casting box defines an aperture. The bottom wall, alternatively, can be completely closed.

The walls of the casting box define an inner volume of the casting box itself, that is, the walls delimit an inner volume of the casting box. As mentioned, the casting box includes an aperture in a bottom area, such as at the bottom wall, so that the box is not a completely closed container. The aperture is provided to cast the slurry. The inner volume of the casting box is thus in contact with the outside. Due to the presence of the aperture, as inner volume of the casting box, the volume of a "theoretical" box where the area defined by the aperture is closed is considered. The demarcation line between the inner volume of the box and the outside is preferably made therefore considering the aperture closed by a wall. The aperture may be formed in more than one wall (for example, corner apertures, which are apertures formed at the corners of the box). Further, more than a single aperture might be present.

The casting box may include a top wall or a lid or it can be open. In case of a lid, it can be fixed, or movable. In the latter case it might be slidable on the sidewalls of the casting box.

The casting blade is preferably arranged perpendicular to the casting direction. The web of material is formed by means of the casting blade that casts the slurry present in the casting box into the movable support. The slurry for example falls by gravity from the casting box and, via the aperture in the bottom wall, comes into contact with the casting blade. An edge of the casting blade forms a gap with the surface of the movable support and the slurry passes through the aperture defined by said gap. The thickness of the cast web of material may be determined by the distance, among others, between the edge of the casting blade that comes into contact with the slurry and the surface of the movable support, that is by the width of the above defined gap.

Preferably, the movable support is positioned at least in part below the aperture on the bottom of the casting box.

The casting box includes a plurality of fins. The fins change the flow path of the slurry flowing from the casting box towards the casting blade. The fins therefore changes the slurry flow, from a substantially "linear" flow, that is a flow along a single substantially straight direction, generally dictated by gravity, to a more complex path because the slurry has to meander through the various surfaces defined by the fins.

Without being bound by theory, the slurry has probably a shear-thinning behavior, that is, there is an inverse proportion between its natural viscosity and the shear strain imposed. Thus, a good mixing of the slurry inside the casting box may be beneficial in the manufacturing process, in particular to control the thickness of the cast sheet. For this reason, preferably, fins which affect the flow of the slurry are inserted in the casting box. The fins, which may have a blade-like form, advantageously work as a mass distributor, as well as static mixing elements, as the slurry during its flow has to contour those fins, dispersing itself and creating non-linear flows. The slurry therefore has a "complex local movement" around the fins and at the same time an overall global movement imparted by the movement of the conveying belt and by the gravity, towards the casting blade.

In this way, a linear flow of the slurry is preferably avoided as much as possible, also in the region where the slurry goes through the thin gap between the casting blade and the movable support. According to the experience in production, longitudinal (with reference to the casting direction) linear flows of the slurry feeding the casting box, and/or inside the casting box, can be correlated with linear transversal inconsistency of the cast sheet, namely in terms of its thickness, physical characteristics, and visual appearance.

The effect that the fins have on the slurry flow may be defined and selected by the specific geometry, size, number and relative proximity between the fins. These parameters may be designed by computer simulations, given the outline of the casting box and the characteristics of the slurry.

Each fin defines a three-dimensional volume. The fins have a dimension which is much smaller than the other two. This smaller dimension is their thickness. The fins are preferably blade-like elements which are positioned in the casting box where they can interfere with the slurry flow. Each fin defines two substantially opposite main surfaces and two thin lateral surface connecting the two main surfaces.

The fins may protrude from one of the sidewalls of the casting box, for example they can be fixed on such a sidewall and extends from an internal surface of the sidewall in contact to the slurry. Preferably, the main surfaces of each fin are substantially perpendicular to the side wall of the casting box.

Alternatively or in addition, the fins may face the movable support. The fins can be mounted so that they face with their lateral surface the movable support or the bottom aperture of the casting box. For this purpose, the fins may be connected one to the others by suitable bars or a frame fixed at the sidewalls of the casting box or the fins may be fixed to a lid of the casting box also facing the aperture located at the bottom of the casting box.

In case many fins are present, all fins can be joined by a connecting element, such as a bar or a frame. The bar or frame may also connect the fins in separate groups. Each group might have a single connecting element different from the other groups. The connection via the connectively element is useful in order to remove all fins at the same time, for cleaning or repairing purposes. Further, it is useful so that the position of all fins can be regulated at the same time.

The fins may be attached directly to the walls of the casting box. The fins may be connected by a frame or bar and the frame or bar may be attached to the sidewalls, preferably to opposite sidewalls, and the fins themselves may not be in contact with the walls of the casting box.

The fins may define an axis. The fins on a top view may form substantially a curve. This curve has a first and a second end. The direction defined by the fins is given by a linejoining the first and the second end. The top view of the fins is a view taken parallel to the lateral surface of the fins.

The fins are preferably curved, that is, they define a concave portion or a convex portion. The fins may have more than a concavity. In a top view, the fins therefore may define a C shape, a S shape or similar. They can also be planar. Preferably, the main surface of the fins is concave of convex.

The possible shapes of the cross-sections of the fins are the ones preferred in order to create the required "deviation" or reorientation of the slurry in each specific position in the casting box.

In terms of materials, fins are preferably realized in metal, more preferably in hard metallic alloys, such as stainless steel hard alloys. Alternatively or in addition, fins may include hardened surfaces, or other materials that have high resistance to the abrasion of the slurry, due to the high content of silica in the tobacco particles and its known abrasion effect in all types of materials, including metals. The "hard" material or coating is used on the fins because of the wear caused by the slurry and the nicotine content of the slurry, which is also chemically aggressive to materials in general.

The presence of fins in the flow path may reduce the differences in the fluidity and related physical characteristics of the slurry which may otherwise be present. "Longitudinal shading bands" which may appear in the cast sheet without the presence of fins may be not present when fins are located in the casting box.

Preferably, the path diverting fins comprise a plurality of curved fins. Preferably, the fins are not flat, but they are curved. The main surfaces of the fins thus include curved surface. The curvature may be used to change the direction of the flow of the slurry in a plurality of different directions, depending on the surface orientation of the fin hit by the slurry.

Preferably, the plurality of curved fins is arranged in at least one row of curved fins. Preferably, many fins are present. More preferably, the fins are arranged along the whole width of the casting box, which is substantially equal to the width of the casting blade, so that all the slurry which moves towards the casting blade is affected by the fins presence. Preferably the fins are disposed one adjacent to the other leaving a space therebetween so that the slurry can flow therethrough. The slurry therefore preferably flows through different channels, each channel being formed by two surfaces, one belonging to a fin and one belonging to the neighbour fin.

Preferably, the fins form groups where all fins "point" toward the same direction. For example, the path diverting fins may be divided in rows, and each row includes fins having parallel axes among each other. The rows of fins are positioned one downstream the other along the direction of flow of the slurry, for example, if a first and a second row of fins are present, the first row of fins is located downtream the second row in the direction of flow of the slurry.

Preferably, each curved of the plurality fins defines a concavity, the curved fins of a same row having equally oriented concavity. "Equally oriented concavity" means that all fins in a row have their concavity on the same side of their axis. The fins may have more than a single curvature. The fins of a row of fins, which preferably span the whole width of the casting box, have preferably their curvatures pointing all in the same direction. The width of the casting box is preferably perpendicular to the casting direction.

Preferably, the curved fins of two adjacent rows have their concavity oppositely oriented. The movement imparted to the flow by the fins is "as complex as possible" so that it deviates from linearity and a better mixing is obtained.

Preferably, the casting apparatus includes a first adjusting element apt to swivel the path diverting fins around an axis. As mentioned above, in a top view the fins define an axis. The orientation of this axis may be changed. Preferably, if there is a plurality of fins, the first adjusting element can change the orientation of the axes of all fins at the same time. Preferably, the orientation of the fins' axes is the same for all fins of the plurality. Preferably, the first adjusting element is located above the fins in a vertical direction. For example, if the casting apparatus includes a lid, the fins are connected to a surface of the lid facing the slurry, while the first adjusting element is located in an opposite surface of the lid. Further, the first adjusting element can be positioned above each single fin. The first adjusting element might be a knob that rotates a shaft inserted in the fin perpendicularly to the main surfaces of the fins.

Preferably, the casting box includes a sidewall and the casting apparatus includes a second adjusting element apt to change a distance between the path diverting fins and the movable support or between the path diverting fins a sidewall of the casting box. As the axis of the fin can be changed, preferably also their height with respect to a vertical axis can be changed as well. A second adjusting element is thus foreseen which can change the positioning of the fins, for example shifting them along a given axis, such as a vertical axis. Preferably, in case of connected fins, the second adjusting element changes the position of all fins at the same time.

This can be done by mechanically synchronizing/indexing the movement of each axis controlling the angle/orientation of each fin with an element that mechanically interact with all axes, for example a bar with a longitudinal gear working with gears existing in each axis of each fin. In this case, the movement of the bar actuates the rotation of all the axes of the fins in the same way, and at the same time.

Preferably, said casting box includes a sidewall, and said path diverting fins face the sidewall of the casting box. Preferably, the path diverting fins are fixed on the sidewall of the casting box.

Preferably, said casting box includes an aperture, the movable support being positioned below the aperture, and said path diverting fins face the movable support. The path diverting fins preferably divert the flow of slurry just before casting. Thus preferably the path diverting fins are positioned above or at the aperture formed in the casting box from which the slurry falls on the movable support, casted by the casting blade. The path diverting fins may be attached to a lid of the casting box or to a frame attached in turn to the sidewalls of the casting box.

The invention also relate to a method for the production of a cast sheet of a material containing alkaloids, the method comprising providing a casting box; providing a casting blade connected to the casting box; providing a movable support facing the casting blade; introducing slurry inside the casting box; providing path diverting fins within the casting box for meandering a flow path of the slurry within the casting box; and casting the slurry on the movable support by means of the casting blade.

The advantages of the method have been already outlined when describing the apparatus and are not going to be repeated.

Preferably, providing path diverting fins includes providing path diverting fins facing the movable support. The path diverting fins can be located in any position inside the casting box. Preferably they are located in the volume through which the slurry flows before casting, such as for example the volume above the aperture in the casting box above the movable support.

Preferably, the method includes adjusting an orientation of the path diverting fins depending on parameters of the slurry or of the cast sheet.

Preferably, the method includes adjusting a distance between the path diverting fins and the movable support or between the path diverting fins a sidewall of the casting box depending on parameters of the slurry or of the cast sheet. More preferably, the method includes the step of swivelling the path diverting fins around an axis perpendicular to the movable support.

The position and the orientation of the path diverting fins can be regulated depending on the characteristics of the slurry and the desired characteristic of the cast sheet. The path diverting fins can be re-oriented and moved from and towards the sidewall, the lid of the casting box or the movable support depending on the location where they are positioned within the casting box.

Preferably, the cast sheet of a material containing alkaloids includes a homogenized tobacco sheet.

The invention may also relate to a casting apparatus for the production of a cast sheet of a material, the casting apparatus comprising: a casting box adapted to contain a slurry of the material containing alkaloids; a slurry supply element adapted to feed the slurry to the casting box; a movable support; a casting blade adapted to cast the slurry contained in the casting box onto the movable support so as to form the cast sheet; and path diverting fins adapted to come into contact with the slurry and placed within the casting box.

The invention may also relate to a method for the production of a cast sheet, the method comprising providing a casting box; providing a casting blade connected to the casting box; providing a movable support facing the casting blade; introducing slurry inside the casting box; providing path diverting fins within the casting box for meandering a flow path of the slurry within the casting box; and casting the slurry on the movable support by means of the casting blade.

Further advantages of the invention will become apparent from the detailed description thereof with no-limiting reference to the appended drawings wherein.

Figure 1:
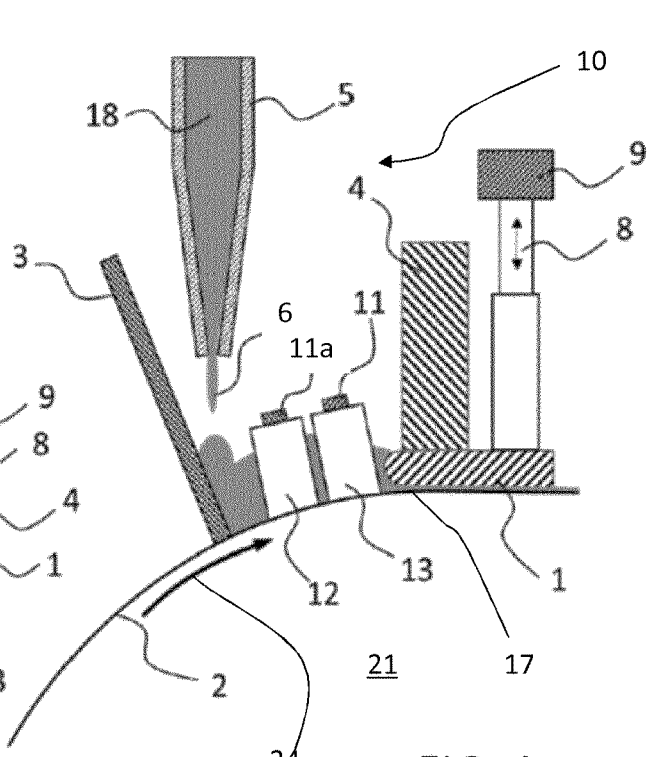
FIG. 1 is a schematic lateral view in section of a portion of an apparatus for the production of a web of a material containing alkaloids.
Figure 2:
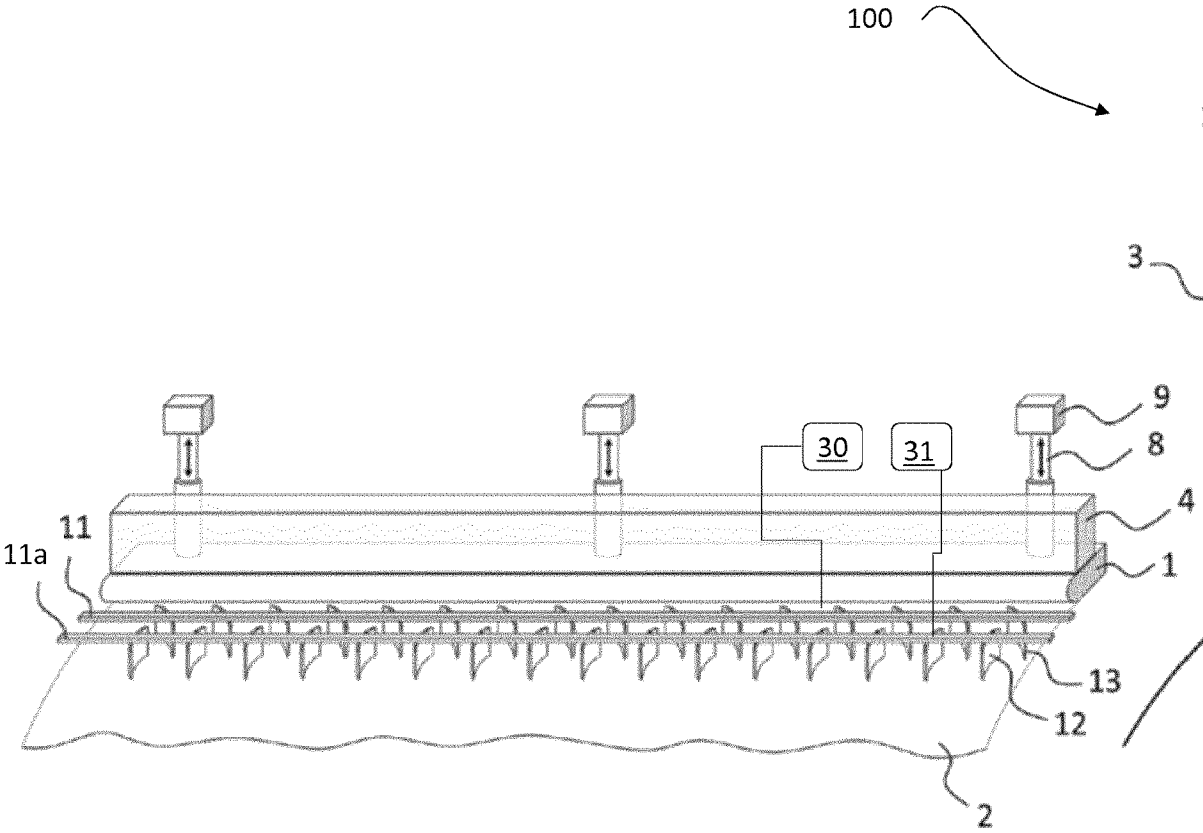
FIG. 2 is a schematic perspective view of the portion of the apparatus of FIG. 1.

With reference to FIGS. 1-4, a first embodiment of a casting apparatus for the production of a cast web of a material containing alkaloids according to the present invention is represented and indicated with reference number 100. Only a portion of the casting apparatus 100 is shown in FIGS. 1 and 2.

In particular, the casting apparatus 100 is adapted for the production of a cast web of a homogenized tobacco material (not depicted in the drawings).

The casting apparatus 100 comprises a casting box 10 containing slurry 18, a movable support 2, and a casting blade 1, wherein the casting blade 1 casts slurry 18 contained in the casting box 10 onto the movable support 2 so as to form the cast sheet of homogenized tobacco material.

Slurry 18 from buffer tanks (not shown in the drawings) is transferred into the casting box 10 usually by means of a pump (not shown in the drawings). Preferably, the pump comprises a control (not visible in the drawing) of flow rate to control the amount of slurry 18 introduced in the casting box 10. The pump is advantageously designed to ensure that slurry transfer times are kept to the minimum necessary. The pump is fluidly connected, for example by means of a slurry distributor 5, to the casting box 10 so as to feed the same with the slurry 2.

The casting box 10 comprises sidewalls including a first and a second opposite walls 3, 4. The casting blade 1 is associated to the casting box 10 at the second wall 4. The casting box 10 is generally defined by four side walls, i.e. the first and second opposite walls 3, 4 and a third and a fourth opposite walls (not shown in the figures), which connect the first and second opposite walls 3, 4.

The movable support 2 comprises for example a continuous stainless steel belt including a drum assembly. The drum assembly includes a main drum 21 located below the casting box 10 which moves the movable support 2. Preferably, the casting box 10 is mounted on top of the main drum 21.

The slurry is casted on the steel belt—at the drum 21—through the casting blade 1, which creates a continuous sheet of homogenized tobacco material. In order for the slurry to reach the casting blade and thus the movable support, the casting box 10 has an opening or aperture 17 in correspondence of its bottom and the opening 17 extends along a width of the casting box 10. The opening 17 is positioned over and in proximity of the drum 21.

The top portion of the casting box 10 in this embodiment is open.

The movement of the steel belt 2 forwards the slurry 18 towards the casting blade 1, for example towards the second wall 4. The casting blade 1 casts a part of the slurry 18 on the steel belt 2, while the remaining majority of the slurry 18 turns back and recirculates inside the casting box 10. The steel belt 2 moves along a casting direction (see the arrow 24 in the figures).

The casting blade 1 is associated to the casting box 10 in order to cast the slurry. The casting blade 1 has a dominant dimension which is its longitudinal width. The casting blade 1 is for example substantially rectangular.

The casting blade 1 is attached to the casting box 10 preferably by means of an adjustable board 8 operated by an actuator 9 which allows a precise control of the position of the casting blade 1, in particular of its distance with respect to the movable support 2.

Between the casting blade 1 and the movable support 2 a gap is present, the dimensions of which determine—among others—the thickness of the cast web of homogenized tobacco material.

The slurry distributor 5 for the transfer of slurry 18 into the casting box, may have different positioning and shapes. In the embodiment of FIG. 1, the slurry is supplied from a single tubular pipeline which is then split in a plurality of pipes. The flow of slurry in each pipe opens up into to a triangular shape in order to adapt and cover the total width of the casting box (similar for example to the pattern depicted for example in FIGS. 6 and 7). The slurry 18 is dropped in a discontinued way directly to the casting box from above, as visible in FIGS. 1, 2 and 3. During the dropping, the slurry drops 6 may touch the sidewall 3 or not.

Further, casting box 10 includes a plurality of fins. The fins are arranged in two substantially parallel first and second row. Any number of rows is possible. The fins of the first row are indicated with 12 and the fins of the second row are indicated with 13. All fins of the first row and all fins of the second row are connected together by respective longitudinal bars 11, 11*a* as shown in FIG. 2. The number of fins in each row is such that the width of the casting box, which is substantially equal to the width of the casting blade 1, is spanned. Each bar 11, 11*a* defines a first and second end which are connected to lateral walls (not shown) of the casting box so that the fins 12, 13 are securely connected to the casting box itself. The bars 11, 11*a* are fixed in such a way that the fins face aperture 17 at the bottom of the casting box and thus also face the movable support 2.

Figure 4:
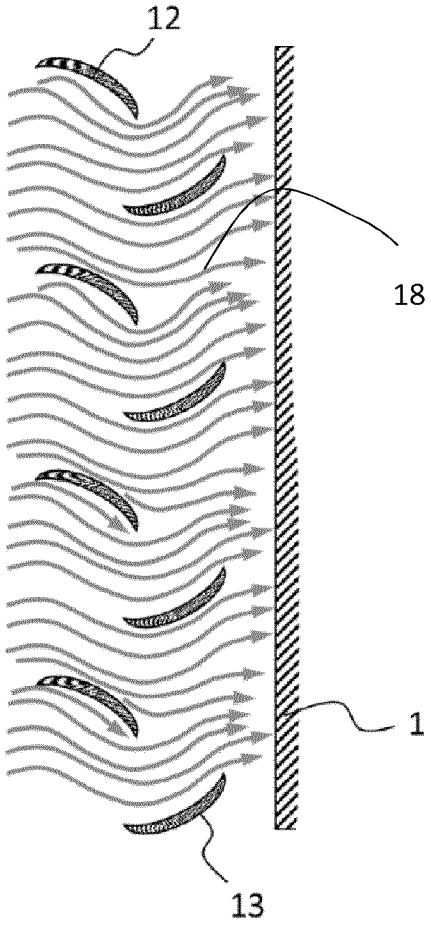
FIG. 4 is a bottom view of a portion of the apparatus of FIGS. 1-3.
Figure 3:
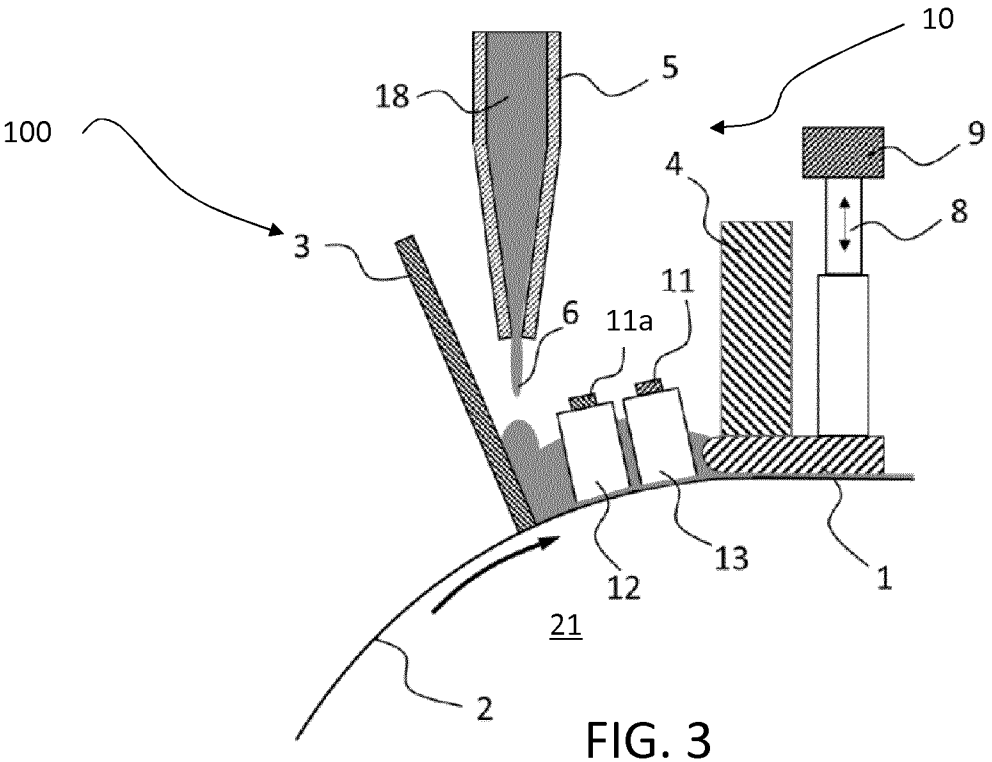
FIG. 3 is schematic lateral view in section of the apparatus of FIG. 1 in a different configuration.

Fins on a top view form a C shape, the concavity of the fins having the same orientation in each row. FIG. 4 shows the row of fins clearly. Each fin 12, 13 has a C shape, where the concavity of the C is positioned substantially facing the main direction of flow of the slurry. Fins 12, 13 all have the same shape and all defines a major dimension, which is positioned substantially parallel to the main flow of the slurry from where the slurry enters the casting box to the casting blade 1.

A first and a second adjusting elements, schematically depicted in FIG. 2 as squares 30, 31, may operate on bars 11, 11*a* in order to change the position of fins. First adjusting element 30 may rotate the fins around an axis so that their orientation changes, while second adjusting element 31 may change the height at which the fins are positioned. The distance between the fins and the movable support may be varied using the second adjusting element. This change of height is visible comparing FIG. 1 and FIG. 3. In FIG. 1, the fins are closer to the movable support 2 than in FIG. 3.

In FIG. 4, the effect of the fins on the flow of slurry is visible. The slurry flows towards the casting blade 1 and the fins 12, 13 causes the path of the slurry to bend and curve, so that the flow is not linear.

Figure 5:
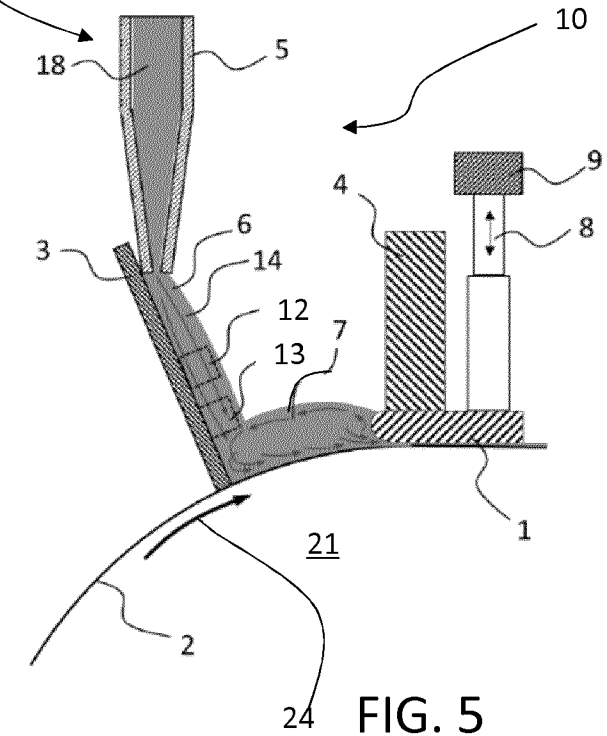
FIG. 5 is a schematic lateral view in section of a second embodiment of an apparatus for the production of a web of a material containing alkaloids.
Figure 6:
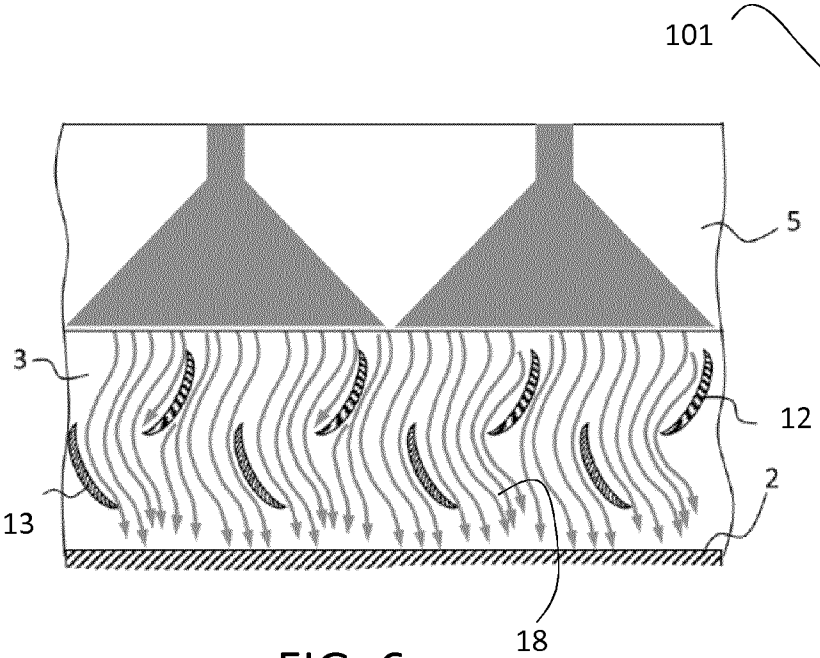
FIG. 6 is a schematic front view of a portion of the apparatus of FIG. 5.
Figure 7:
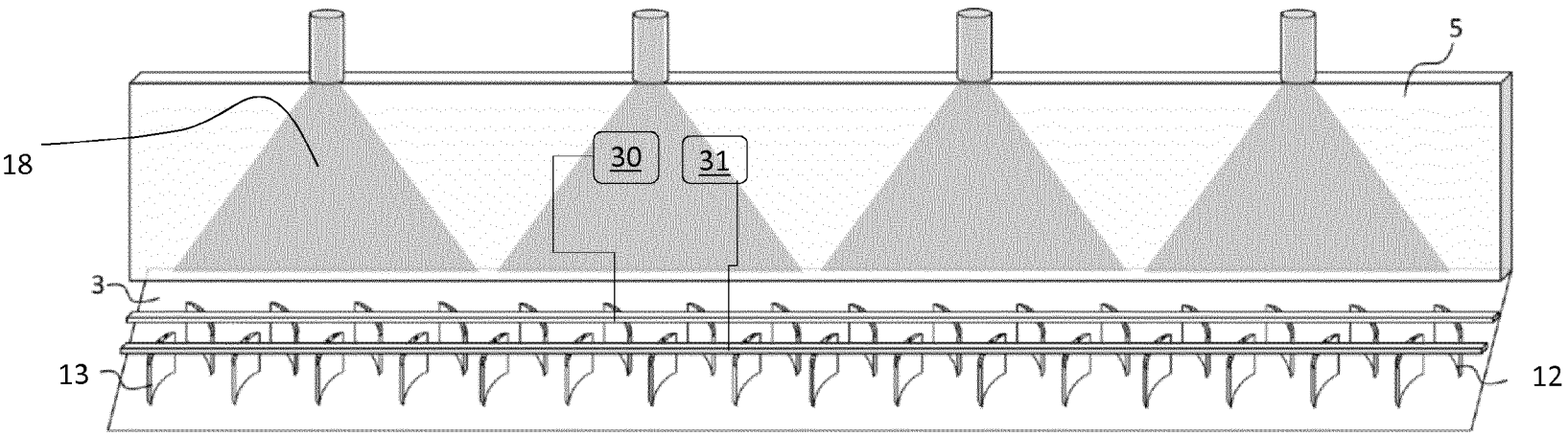
FIG. 7 is a schematic perspective view of FIG. 5.

In FIG. 5-7, a second embodiment of the apparatus 101 to form a cast sheet is depicted. The difference between the apparatus 100 and the present apparatus 101 relates to the positioning of the fins 12, 13. The fins in this embodiment are fixed on the sidewall 3 of the casting box 10. Preferably, sidewall 3 is tilted, that is, it is not vertical, but if forms an angle with a vertical plane. The slurry which falls from the slurry distributor 5 impinges on an inner surface of the sidewall 3 and slide on the surface towards the moving support 2 and casting blade 1. The fins are positioned in the flow path of the slurry on the sidewall 3. The fins are positioned at two different height, the first row of fins 12 being higher than the second row of fins 13.

As shown in FIG. 6, the effect on the flow of slurry of fins 12, 13 is the same as fins 12, 13 of the previous embodiment. The position of fins 12, 13 may also be changed due to the presence of the first and second adjusting element (see FIG. 7).

Figure 8:
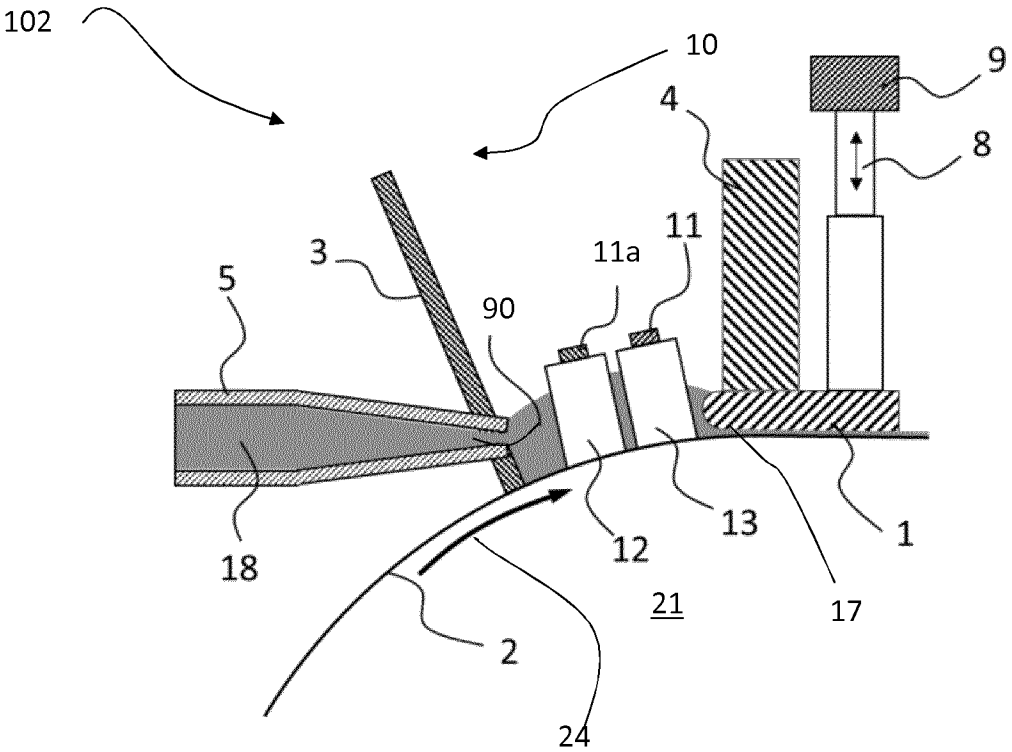
FIG. 8 is a schematic lateral section view of a third embodiment of an apparatus for the production of a web of a material containing alkaloids.

In FIG. 8, a third embodiment of an apparatus 102 for the casting of a sheet is visualized. In this embodiment, the fins are positioned as in the first embodiment of FIGS. 1-4, however the slurry distributor 5 is different.

The fluid distributor 5 includes an inlet 90 which is formed on the sidewall 3 of the casting box 10. Preferably, the fluid distributor 5 includes a pipe arranged substantially horizontal, so that at the opening (inlet 90) formed by the pipe on the sidewall 3, the direction of the flow of slurry is substantially horizontal.

Figure 9:
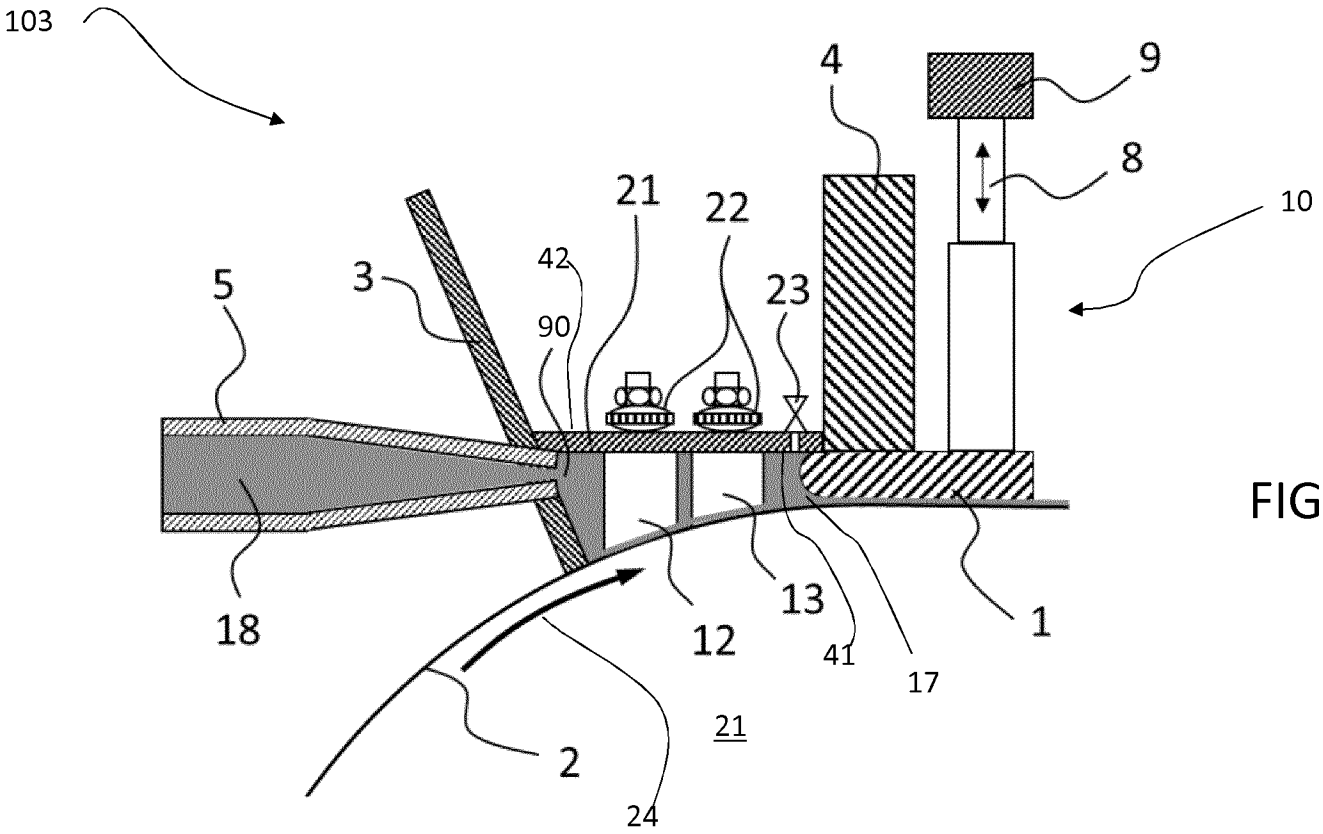
FIG. 9 is a schematic lateral section view of a fourth embodiment of an apparatus for the production of a web of a material containing alkaloids.

With now reference to FIG. 9, a fourth embodiment of the apparatus 103 is disclosed. The casting box 10 in this embodiment also includes a lid 21. The lid 21 may be fixed or it may slide on the sidewalls 3, 4. Lid 21 defines opposite surfaces called internal and external 41, 42. The internal surface faces the slurry, while the external is opposite to it. The lid may be in contact with the slurry. The walls and lid of the casting box 10 defines a pressurized container. In order to be able to vary the pressure value inside such a pressurized container, a valve (or more than a valve) 23 is positioned on the external surface of the lid 21. The maximum value of acceptable pressure can be changed on the valve 23.

Further, a first and a second row 12, 13 of fins extend from the internal surface 41 of the lid towards the slurry 2. The two rows of fins are preferably one parallel to the other and are attached to the lid. On the opposite side of the lid, i.e. on the external surface 42, regulation devices, both indicated by 22, are accessible by a user and can be used to rotate the fins 12, 13. Regulation devices 22 may include knobs.

Slurry is introduced in the casting box by means of the slurry distributor 5 configured as in the third embodiment of FIG. 8.

The functioning of the casting apparatus 100-103 is as follows. A slurry 18, formed preferably mixing and combining tobacco powder and other ingredients, is transferred from a buffer tank (not shown) using for example in line mixers (also not shown) to the casting apparatus 100—103 and in particular inside the casting box 10.

The slurry 18 is supplied for example at the inlet 90, which is positioned at a rear/upstream side of casting box 10 (at the sidewall 3 of the casting box 10) and the casting blade 1 is located at a front/downstream side of the casting box 10, near the sidewall 4. Alternatively, slurry is distributed from above, e.g. it enters the casting box via the open top portion of the same, and falls on the casting box or slides along sidewall 3. Along the casting direction 24, the slurry has to pass through two rows of fins 12, 13 which are located substantially at the middle of casting box 10, between the first and the second wall 3, 4 (embodiments of FIG. 1, 8, 9). Alternatively, fins 12, 13 are positioned along the wall 3. The position of the fins is regulated operating on regulation device 30, 31, 22 which may alter the orientation of fins and their height.

In case a lid 21 is present, the pressure inside the casting box 10 is controlled by positioning the lid 21 and regulating valve 23 or letting the lid float on the slurry 18.

Further, the level of slurry in the casting box 10 is monitored, as well as the moisture of the slurry inside the casting box 10, and the density of the slurry 18, by means of suitable sensors.

The thickness of the web of homogenized tobacco material and grammage controlled by nucleonic gauge immediately after casting are continuously monitored and feedback-controlled using slurry measuring device. The casting is performed by means of casting blade 1 forming a gap with the movable support 2, gap that can also be feedback controlled.

Further, the cast web undergoes a drying step by means of a drying apparatus (not visible in the drawings). The drying apparatus includes a plurality of individual drying zones. Each drying zone preferably includes steam heating on the bottom side of the support and heated air above the movable support 2 and preferably also adjustable exhaust air control. Within the drying apparatus, the homogenized tobacco web is dried to desired final moisture on the support 2.

The drying step includes preferably a uniform and gentle drying of the cast web in an endless, stainless steel belt dryer with individually controllable zones. During the drying, a monitoring step of the cast web temperature at each drying zone to ensure a gentle drying profile at each drying zone is preferably performed. The cast web is dried to desired final moisture on the steel belt 2 with steam pan heating from bottom and top air drying. Every drying zone is equipped with steam flow and pressure control and air temperature and air flow are fully adjustable to provide the desired drying profile and ensuring product residence time is respected.

The invention claimed is:

1. Casting apparatus for the production of a cast sheet of a material containing alkaloids, the casting apparatus comprising:

a casting box adapted to contain a slurry of the material containing alkaloids;

a slurry supply element adapted to feed the slurry to the casting box;

a movable support;

a casting blade adapted to cast the slurry contained in the casting box onto the movable support so as to form the cast sheet; and path diverting fins adapted to come into contact with the slurry and placed within the casting box.

2. The casting apparatus according to claim 1, wherein the path diverting fins comprise a plurality of curved fins.

3. The casting apparatus according to claim 2, wherein the plurality of curved fins is arranged in at least one row of curved fins.

4. The casting apparatus according to claim 3, wherein each curved fins of the plurality defines a concavity, the curved fins of a same row having equally oriented concavity.

5. The casting apparatus according to claim 4, wherein the curved fins of two adjacent rows have their concavity oppositely oriented.

6. The casting apparatus according to claim 1, comprising a first adjusting element apt to swivel the path diverting fins around an axis.

7. The casting apparatus according to claim 1 wherein said casting box comprises a sidewall, and comprising a second adjusting element apt to change a distance between the path diverting fins and the movable support or between the path diverting fins and the sidewall of the casting box.

8. The casting apparatus according to claim 1, wherein said casting box includes a sidewall, and said path diverting fins face the sidewall of the casting box.

9. The casting apparatus according to claim 1, wherein said casting box includes an aperture, the movable support being positioned below the aperture, and said path diverting fins face the movable support.

10. A method for the production of a cast sheet of a material containing alkaloids, the method comprising:

providing a casting box;

providing a casting blade connected to the casting box;

providing a movable support facing the casting blade;

introducing slurry inside the casting box;

providing path diverting fins within the casting box for meandering a flow path of the slurry within the casting box; and casting the slurry on the movable support by means of the casting blade.

11. The method according to claim 10, wherein providing path diverting fins includes:

providing path diverting fins facing the movable support.

12. The method according to claim 10, including:

adjusting an orientation of the path diverting fins depending on parameters of the slurry or of the cast sheet.

13. The method according to claim 10, including:

adjusting a distance between the path diverting fins and the movable support or between the path diverting fins and a sidewall of the casting box depending on parameters of the slurry or of the cast sheet.

14. The method according to claim 13, including:

Swivelling the path diverting fins around an axis perpendicular to the movable support.

15. The method according to claim 10, wherein the cast sheet of a material containing alkaloids includes a homogenized tobacco sheet.

16. The casting apparatus of claim 2, wherein a line joining between a first end and a second end of each fin is a curve, the curve extending along the main direction of flow of the slurry.

17. The casting apparatus of claim 16, wherein the curve defines a concavity.

* * * * *